United States Patent [19]

Marín et al.

[11] Patent Number: 4,863,569

[45] Date of Patent: Sep. 5, 1989

[54] SUPPORT FOR A DEVICE FOR CLEANING THE DOORS OF A BATTERY-ARRANGED COKE FURNACE

[75] Inventors: Gerardo A. Marín, Oviedo; Enrique E. Alonso, Aviles; Juan-Francisco S. Sánchez, Gijon, all of Spain

[73] Assignee: Empresa Nacional Siderugica, S.A., Gijon, Spain

[21] Appl. No.: 119,307

[22] Filed: Nov. 6, 1987

Related U.S. Application Data

[63] Continuation of Ser. No. 815,880, Jan. 3, 1986, abandoned.

[30] Foreign Application Priority Data

Jun. 21, 1985 [ES] Spain ..... 544452

[51] Int. Cl.[4] ..... C10B 43/04

[52] U.S. Cl. ..... 202/241; 15/93 A; 134/141; 248/648; 248/651

[58] Field of Search ..... 202/241; 15/93 A, 93 R; 414/569; 134/137, 138, 157, 159, 140, 141; 248/648, 651, 654, 331

[56] References Cited

U.S. PATENT DOCUMENTS

| | | | |
|---|---|---|---|
| 3,543,322 | 12/1970 | Stanke et al. | 15/93 A |
| 3,633,233 | 1/1972 | McCullough et al. | 15/93 A |
| 4,080,220 | 3/1978 | Neumann | 202/241 |
| 4,110,171 | 8/1978 | Baird et al. | 202/241 |
| 4,344,204 | 8/1982 | Fujita et al. | 202/241 |

*Primary Examiner*—Joye Woodard

*Attorney, Agent, or Firm*—Ladas & Parry

[57] ABSTRACT

A device for cleaning the doors of battery-arranged coke furnaces is provided. The device is suspended at four points from steel cables which pass along a pulley and are joined at its other end to a counter-weight. The cable is joined to the counter-weight in a resilient manner by compression actuated springs. The door to be cleaned is correctly positioned by the presence of sliders incorporated into the device and due to the floating arrangement of the device.

4 Claims, 3 Drawing Sheets

SUPPORT FOR A DEVICE FOR CLEANING THE DOORS OF A BATTERY-ARRANGED COKE FURNACE

This is a continuation of co-pending application Ser. No. 815,880 filed on Jan. 3, 1986, now abandoned.

BACKGROUND OF THE INVENTION

The present invention refers to improvements in a device for cleaning the doors of battery-arranged coke furnaces which have been designed and constructed to substantially improve the structure and efficiency of currently used systems having the same end purpose.

A major problem presented by these furnaces is the lack of tightness between the doors, leading to both air inlets as well as gas emissions, with the consequent contamination and economic losses.

Normally, and to a greater extent than others, this is due to an improper cleaning of the frames and above all of the doors, inasmuch as it is difficult to service the devices which are mounted on travelling machines, therefore also presenting a risk for the personnel in charge of repairing and servicing them.

Currently, there exist various devices for cleaning the doors used by the manufacturers of this type of coke furnaces which are installed on the coke guiding machines or coke extracting machines (furnace removers).

All these devices mainly consist of a frame which supports a mechanism moving the cleaning tools comprised of scraping blades, brushes, etc. In accordance which the invention, there is provided a movable carriage for a door cleaning device which can be used by any of the current cleaning devices without having to be installed on the coke guiding machine or furnace remover, since it is mounted on a fixed structure.

SUMMARY OF THE INVENTION

The door cleaning device proportioned by this invention is suspended at four points from steel cables which pass along a pulley and are joined at the other end to a counterweight. The cable is joined to the counterweight in a resilient manner by compression actuated springs.

The device is moved toward the door by four pneumatic cylinders which are air-operated from the industrial network.

The cylinders and pulleys are secured to two uprights positioned at the most appropriate space of the battery-arranged furnaces.

The guide carriage, along with the door to be cleaned, is positioned in front of the described device, the door removing device moves and positions the door in the plane corresponding to the furnace blade and frame line shaft, whereafter the pneumatic cylinders move the cleaning device forward so that the cleaning tools contact the door to be cleaned. This operation is performed by the machinist who activates the rotary distributor of the pneumatic circuit. The door is correctly coupled due to the presence of sliders placed on the door cleaning device and to the floating arrangement of this device.

The tool is then operated to clean the door, whereafter, by pneumatic activation, the door cleaner is withdrawn and the guide carriage can remove the door. The cleaning tools can then return to their inoperative position.

Since the apparatus slides towards the door to be cleaned and since it is removed, the movements of the said cleaning tools can be initiated automatically or manually, at the operator's will. Both movements are blocked by a slide-operated end of stroke. To lubricate the various mechanisms, an automatic pressure-fed lubricating installation is incorporated.

The oil pump, the electric cabinet and the electric and pneumatic controls are neither placed on the cleaning device nor on the movable carriage, but separated so that they are protected from the heat of the door. The control panel is placed at such a location that the operator can handle the controls whilst having a good vision of the operation.

With this invention, the doors of battery-arranged coke furnaces can be cleaned with the following advantages:

Lower maintenance costs

Improved cleaning of the doors

Lesser need for cleaning, since it is effective

High efficiency of the installed device, irrespective of its type, since it can be adjusted without the presence of the machine.

A better tightness is achieved with the proposed system, without any delays in the production due to the apparent time loss involved in the movement of the guide carriage, along with the door, to the device in question.

BRIEF DESCRIPTION OF THE DRAWINGS

For a better understanding of the invention, reference is made to this description taken in conjunction with the accompanying drawings in which, illustratively and not limiting, the following is represented.

DESCRIPTION OF THE PREFERRED EMBODIMENT

Figure 1:
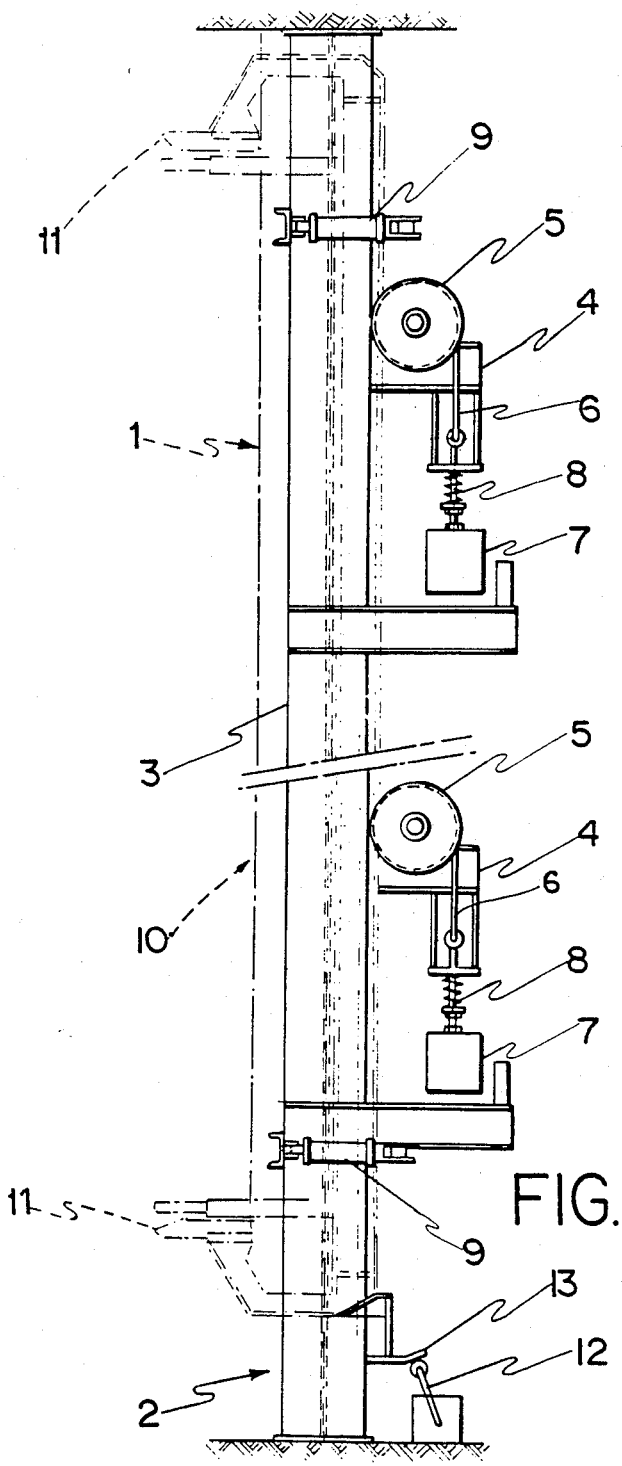
FIG. 1 is a side elevational view of the door cleaning device floatingly arranged on a fixed frame.
Figure 2:
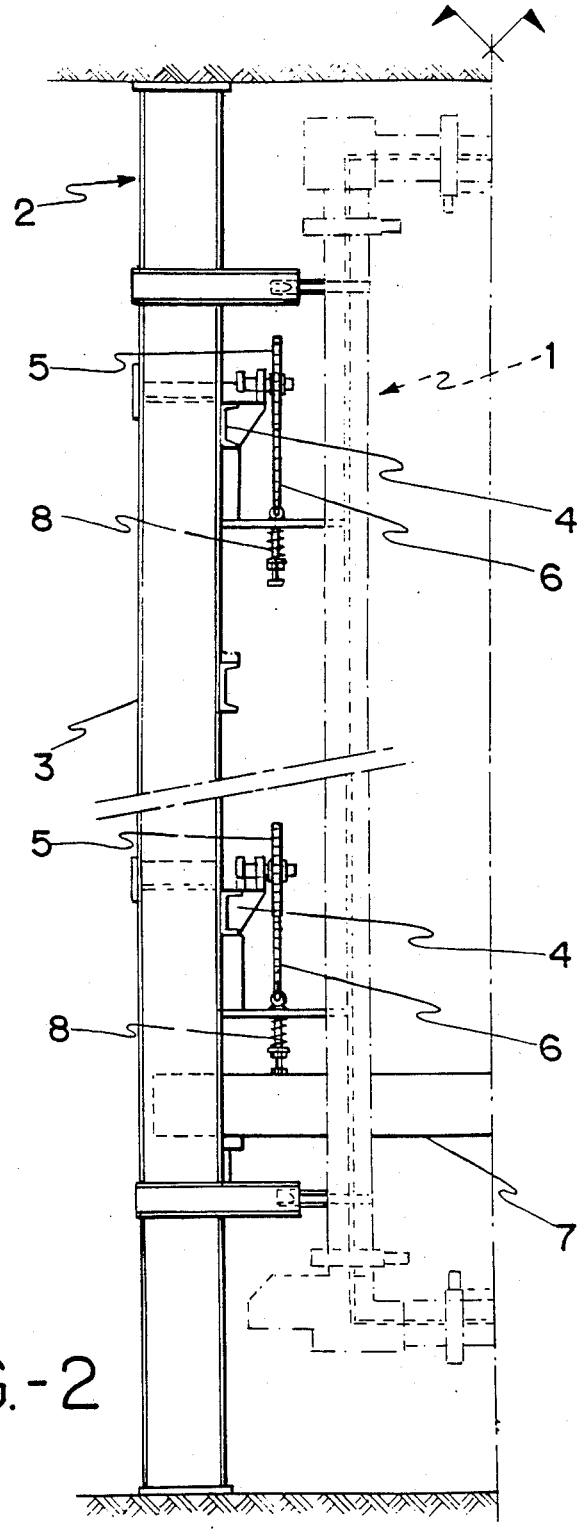
FIG. 2 is a front elevational view of FIG. 1.

Referring to the said drawings, the door cleaning device, generally designated by 1, including the cleaning tools, such as scraping blades or brushes joined to an operating system, is disposed in a floating position on a fixed frame 2. The fixed frame 2 includes two uprights 3 to which are secured the supports 4 for the pulleys 5 through which the steel cables 6 pass. One end of the cable 6 is secured to the door cleaning device 1 and the other end is secured to a counterweight 7. The cable is joined to the counterweight 7 in a resilient manner by means of compression actuated springs 8.

There are two counterweights 7, one for the two upper cables and another for the two lower cables.

The floating frame constituting the door cleaning device 1 can move toward or away from the door to be cleaned by means of four pneumatic cylinders 9 secured to the uprights 3.

The guide carriage, along with the door to be cleaned, is positioned in front of the door cleaning device 1. The door removing mechanism moves and positions the door in the plane corresponding to the furnace blade and frame line shaft, designed by 10 in FIG. 1. The door is correctly positioned by sliders 11 incorporated in the door cleaning device 1.

The movement of the cleaning tools to operate at the precise moment automatically or manually, is blocked by means of an end of stroke 12 when pressed by a slide 13.

Figure 3:
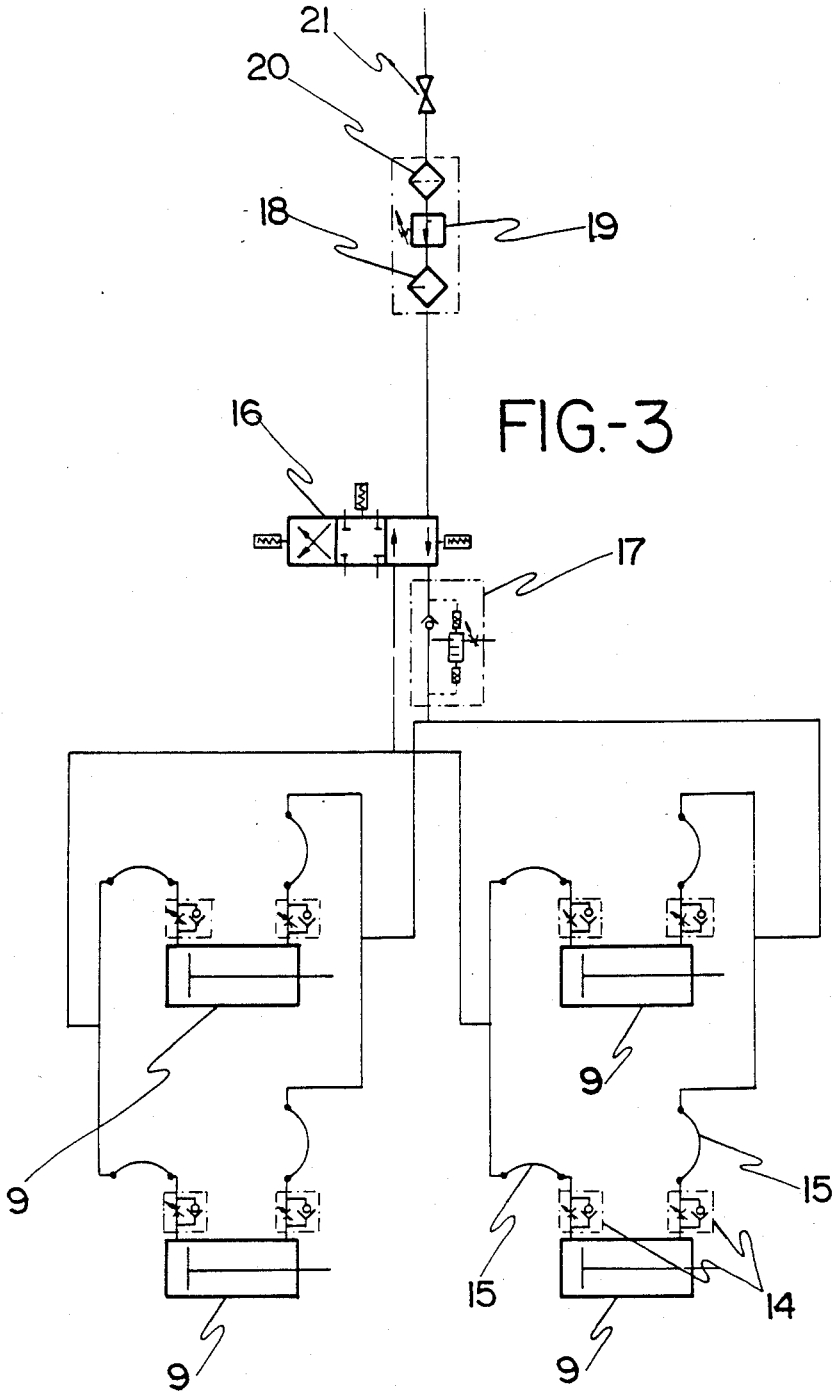
FIG. 3 is a scheme of the pneumatic circuit for operating the device.

FIG. 3 illustrates a scheme of the pneumatic circuit for operating the cylinders 9 through flow adjusters 14 and flexible hoses 15, displacements controlled by a rotary distributor 16, the circuit incorporating the corresponding rapid release valve 17, lubricator 18, pressure adjuster 19 and air filter 20, and a by-pass valve 21 being connected to the compressor.

We claim:

1. An apparatus for supporting a device for cleaning doors of a battery-operated coke furnace, comprising:

a fixed frame comprising two uprights;

a plurality of pulleys;

at least two vertically spaced support means fixed to each of the uprights, and respectively supporting a pulley of the plurality of pulleys;

at least one counterweight;

a plurality of cables, each cable of the plurality of cables passing over a respective pulley of the plurality of pulleys and having one end for securement to a door cleaning device and an opposite end secured to the at least one counterweight; and two pneumatic cylinders transversely secured respectively to the uprights for moving a door cleaning device, when secured to the one end of each of the cables, toward and away from the uprights transversely of the uprights.

2. The apparatus defined in claim 1, further comprising compression-actuated spring means securing the opposite end of each of the cables to the at least one counterweight.

3. The apparatus defined in claim 1, wherein the at least two vertically spaced support means comprises an upper and a lower support means fixed to each of the uprights and the at least one counterweight comprises two counterweights, and the opposite ends of the cables passing over the pulleys supported on the upper support means fixed to each of the uprights are secured to one of the two counterweights, and the opposite ends of the cables passing over the pulleys supported on the lower support means fixed to each of the uprights are secured to the other of the two counterweights.

4. The apparatus defined in claim 2, wherein the at least two vertically spaced support means comprises an upper and a lower support means fixed to each of the uprights and the at least one counterweight comprises two counterweights, and the opposite ends of the cables passing over the pulleys supported on the upper support means fixed to each of the uprights are secured to one of the two counterweights and the opposite ends of the cables passing over the pulleys supported on the lower support means fixed to each of the two uprights are secured to the other of the two counterweights.

* * * * *

UNITED STATES PATENT AND TRADEMARK OFFICE

CERTIFICATE OF CORRECTION

PATENT NO. : 4,863,569

DATED : September 5, 1989

INVENTOR(S) : Gerardo Arancon Marin, et al

It is certified that error appears in the above-identified patent and that said Letters Patent is hereby corrected as shown below:

Title page, under item (19), "Marin et al." should read --Arancon Marin et al.--.

Title page, inventors should read

--Gerardo Arancon Marin, Ovieda, Spain; Enrique Echevarria Alonso, Aviles, Spain; Juan F. Suarez Sanchez, Gijon, Spain--.

Signed and Sealed this

Twenty-third Day of October, 1990

*Attest:*

HARRY F. MANBECK, JR.

*Attesting Officer*

*Commissioner of Patents and Trademarks*